US009668567B2

(12) United States Patent
Gill et al.

(10) Patent No.: US 9,668,567 B2
(45) **Date of Patent: *Jun. 6, 2017**

(54) ADJUSTABLE LOAD CARRIER DEVICE

(71) Applicant: SOURCE VAGABOND SYSTEMS LTD., Tirat Hacarmel (IL)

(72) Inventors: Yoram Gill, Haifa (IL); Hanan Almus, Herzlia (IL); Jonathan Bar-Or, Kibbutz Degania (IL); Jonathan Roth, Pardes Hanna-Karkur (IL); Shoham Zak, Givat Ela (IL)

(73) Assignee: SOURCE VAGABOND SYSTEMS LTD., Tirat Carmel (IL)

( * ) Notice: Subject to any disclaimer, the term of this patent is extended or adjusted under 35 U.S.C. 154(b) by 0 days.

This patent is subject to a terminal disclaimer.

(21) Appl. No.: 15/393,517

(22) Filed: Dec. 29, 2016

(65) Prior Publication Data

US 2017/0105509 A1 Apr. 20, 2017

Related U.S. Application Data

(63) Continuation of application No. 14/294,148, filed on Jun. 3, 2014, now Pat. No. 9,545,144.

(30) Foreign Application Priority Data

Jun. 6, 2013 (IL) ..... 226809

(51) Int. Cl.
*A45F 3/14* (2006.01)

(52) U.S. Cl.
CPC ..... *A45F 3/14* (2013.01); *A45F 2003/144* (2013.01); *A45F 2003/146* (2013.01)

(58) Field of Classification Search
CPC ..... A45F 2003/007; A45F 2003/045; A45F 2003/127; A45F 3/14; A45F 3/04; A45F 3/047; A45F 3/08; A45F 2003/144
See application file for complete search history.

(56) References Cited

U.S. PATENT DOCUMENTS 4,013,201 A 3/1977 Potter
4,298,149 A 11/1981 Gottschalk et al.
(Continued)

FOREIGN PATENT DOCUMENTS

DE 102004027105 1/2006
EP 0351333 1/1990

OTHER PUBLICATIONS

Office Action for U.S. Appl. No. 14/294,148 dated Mar. 2, 2016.
European Search Report for EP Application No. EP14169804 dated Nov. 11, 2014.

*Primary Examiner* — Corey Skurdal

(74) *Attorney, Agent, or Firm* — Pearl Cohen Zedek Latzer Baratz LLP

(57) ABSTRACT

An adjustable device for supporting a load includes a belt for fastening about a user's waist. A rod includes two rigid elements. One of the elements is longitudinally slidable relative to the other element so as to adjust a length of the rod. A lower end of the rod is attachable to the belt and an upper section of the rod is attachable to a shoulder harness that is placeable on the user's shoulders for carrying the load. A control is operable by the user when carrying the load to unlock a locking mechanism that, when locked, fixes the length of the rod. When the control is operated concurrently with movement of the user's shoulders relative to the user's waist, the length of the rod is changed to adjust a distribution of a weight of the load between the user's shoulders and waist.

15 Claims, 8 Drawing Sheets

(56) References Cited

U.S. PATENT DOCUMENTS

| | | | |
|---|---|---|---|
| 4,860,936 | A | 8/1989 | Lowe |
| 5,004,135 | A | 4/1991 | Dufournet et al. |
| 5,449,102 | A | 9/1995 | Sason |
| 5,503,314 | A | 4/1996 | Fiscus |
| 5,806,740 | A | 9/1998 | Carlson |
| 5,954,250 | A | 9/1999 | Hall et al. |
| 6,536,641 | B1 | 3/2003 | Sundara et al. |
| 8,556,840 | B2 | 10/2013 | Burke et al. |
| 2006/0011689 | A1 | 1/2006 | Reid |
| 2014/0151424 | A1 | 6/2014 | Hexels |

ADJUSTABLE LOAD CARRIER DEVICE

CROSS REFERENCE TO RELATED APPLICATIONS

The present application is a continuation of U.S. patent application Ser. No. 14/294,148, filed on Jun. 3, 2014 and published as US Patent Application Publication No. 2014/0361058 on Dec. 11, 2014, which claims the priority benefit of Israeli Patent Application No. 226809, filed on Jun. 6, 2013, which is incorporated in its entirety herein by reference.

FIELD OF THE INVENTION

The present invention relates to a load carrier device.

BACKGROUND OF THE INVENTION

Backpacks and other load carrier devices and systems are often designed to fit over the shoulders of a user who is carrying the load. Thus, the shoulder straps generally place the weight of the load on the user's shoulders. Additional straps generally serve to prevent the load from shifting laterally or from falling off the shoulders.

Backpacks are used by a wide range of users, both professional and non-professional. For example, non-professional users may include students, hikers, travelers, or parents of small children. Professional users may include firefighters, military or law enforcement personnel, forest or park rangers, tour guides, or rescue workers. A loaded backpack may be very heavy. For example, an infantry soldier, depending on the nature of a particular task or mission, may be required to carry weapons, ammunition, water, food, body armor, tools, communication equipment, and reconnaissance equipment. The weight of this equipment may, in some cases, be similar to the weight of the body of the person carrying the load.

When traveling large distances on foot, a loaded backpack may become extremely uncomfortable to carry. Excessive force may be exerted on the shoulders or back of the person carrying the backpack. In addition to causing discomfort, the excessive force could lead to back pain or injury.

SUMMARY OF THE INVENTION

There is thus provided, in accordance with some embodiments of the present invention, an adjustable device for supporting a load, the device including: a belt for fastening about a waist of a user; a rod including two rigid elements, one of the elements being longitudinally slidable relative to the other element so as to adjust a length of the rod, the rod further including a locking mechanism that is operable to prevent sliding of the slidable element so as to fix the length of the rod, a lower end of the rod being attachable to the belt and an upper section of the rod being attachable to a shoulder harness that is placeable on the user's shoulders for carrying the load; and a control that is operable by the user when carrying the load to unlock the locking mechanism, such that, when the control is operated concurrently with movement of the user's shoulders relative to the user's waist, the length of the rod is changed to adjust a distribution of a weight of the load between the user's shoulders and waist.

Furthermore, in accordance with some embodiments of the present invention, the control is operable to momentarily unlock the locking mechanism while the user is operating the control.

Furthermore, in accordance with some embodiments of the present invention, the locking mechanism or the control includes a spring to lock the locking mechanism when the user stops operating the control.

Furthermore, in accordance with some embodiments of the present invention, the control is operable to continuously unlock the locking mechanism until the control is operated to lock the locking mechanism.

Furthermore, in accordance with some embodiments of the present invention, the control is operable by a single hand.

Furthermore, in accordance with some embodiments of the present invention, the belt includes a sheath into which the lower end of the rod is insertable.

Furthermore, in accordance with some embodiments of the present invention, an attachment of the lower end of the rod to the belt is connected to the belt by a flexible strip.

Furthermore, in accordance with some embodiments of the present invention, an attachment of the lower end of the rod to the belt enables the rod to lean laterally or to rotate laterally.

Furthermore, in accordance with some embodiments of the present invention, the rigid elements include a male telescoping element and a female telescoping element.

Furthermore, in accordance with some embodiments of the present invention, the female telescoping element is attachable to the shoulder harness.

Furthermore, in accordance with some embodiments of the present invention, the upper section of the rod is attachable to the shoulder harness by straps that are threaded through loops on the shoulder harness.

Furthermore, in accordance with some embodiments of the present invention, the locking mechanism includes, on one of the rigid elements, teeth that are extendible to engage corresponding fixed teeth on the other rigid element so as to lock the locking mechanism Furthermore, in accordance with some embodiments of the present invention, the extendible teeth are mounted on an arm that is rotatable outward to engage the fixed teeth.

Furthermore, in accordance with some embodiments of the present invention, the locking mechanism includes a wedge that is slidable to one position to press the arm outward and to another position to allow the arm to rotate inward.

Furthermore, in accordance with some embodiments of the present invention, the extendible teeth are mounted on a male telescoping element of the rod, and the fixed teeth are mounted on a female telescoping element of the rod.

Furthermore, in accordance with some embodiments of the present invention, the control is operable by turning a knob.

Furthermore, in accordance with some embodiments of the present invention, the control is operable to continuously unlock the locking mechanism by turning the knob until a tab of the knob engages stop.

Furthermore, in accordance with some embodiments of the present invention, the control is operable to lock the mechanism after being continuously unlocked by moving the stop to release the tab from the stop.

Furthermore, in accordance with some embodiments of the present invention, the control is connected to the locking mechanism via a cable.

Furthermore, in accordance with some embodiments of the present invention, one of the rigid elements is curved.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention. Like components are denoted by like reference numerals.

DETAILED DESCRIPTION OF THE INVENTION

Figure 1:
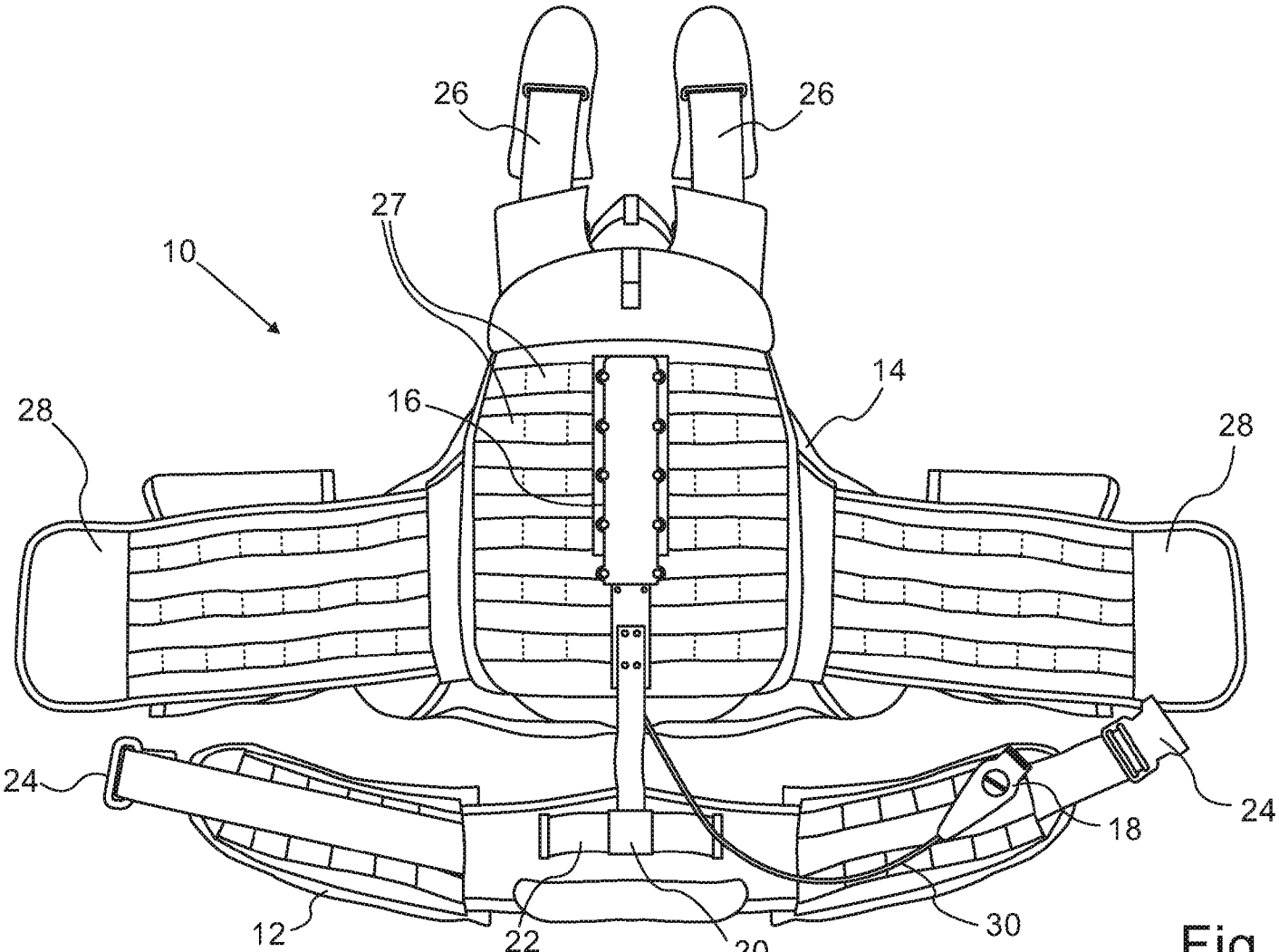
FIG. 1 shows an adjustable load carrier device, in accordance with an embodiment of the present invention.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

In accordance with embodiments of the present invention, an adjustable load carrier device is provided that enables a user of the device and who is carrying the load to adjust of distribution of the load between the user's shoulders and the user's waist. The load is carried by a shoulder harness that is attachable to the adjustable load carrier device. For example, the load may be carried by one or more of carrying accessories that are attached to the shoulder harness. The shoulder harness includes shoulder straps that fit over the user's shoulders.

The adjustable load carrier device is provided with a belt. The belt may be fastened about the waist of the user. The belt may be configured (e.g., may have sufficient thickness or firmness) to comfortably support the weight of the load. The belt includes a rod holder for holding and supporting a lower end of a rod. For example, the rod holder may include a sheath into which the lower end of the rod may be inserted. Another attachment arrangement, such as a sleeve, connector, pin, loop, hook, or other arrangement may be provided for holding a lower end of a rod. (Upper and lower ends of the rod, as referred to herein, are defined with reference to a natural orientation of the rod when the adjustable carrier device is worn by a user who is standing upright and in a manner as described herein.) The length of the rod is adjustable when a locking mechanism is unlocked. When the locking mechanism is locked, the length of the rod is fixed.

All or part of the rod may be in the form of a flattened bar (e.g., with a thin rectangular, oval, rounded rectangular, or other flattened cross section). All or part of the bar may have a circular or oval, square or rectangular, polygonal, rounded square or rectangular, or other cross section. Different sections of the rod may have different cross sections. A cross section of the rod may be selected to provide sufficient strength to the rod, to facilitate a connection or attachment to the belt or to the shoulder harness, to provide comfort or ease of use to the user, to provide a desired appearance, to provide ease of manufacture, or in accordance with other considerations.

The rod holder may be configured to enable the rod to rotate about one or more axes. For example, the rod holder may include a sheath or other attachment that is connected to the belt by a flexible connecting strip (e.g., of nylon, polymer, or other webbing, or another cloth with sufficient strength to support the rod and the load). As another example, the sheath may be incorporated (e.g., as a pocket) into the flexible strip. The ends of the strip are attached to the belt, enabling a central portion of the strip that includes the sheath to have at least limited rotational freedom. For example, such a flexible connection may enable the rod to lean laterally (e.g., toward the user's right or left) or to rotate laterally (e.g., when the user's torso is twisted about the waist).

The enabled rotational freedom may accommodate lateral leaning of the user's torso to the right or to the left (e.g., rotation that is substantially in a coronal plane of the user's body), or lateral rotation or twisting of the user's torso to the right or to the left (e.g., rotation that is substantially in a transverse plane of the user's body). Alternatively or in addition, the rod holder may be attached to the belt using a hinged, gimbaled, or other connection that enables rotation about one or more axes or in one or more planes.

The length of the rod is adjustable. An upper end or section of the rod is configured to attach to and to support the shoulder harness. The attachment is such that, when attached, the shoulder harness does not separate from the rod when pulled. For example, the upper end of the rod may be attached to the shoulder harness using straps, clips, buckles, side release buckles, buttons, snaps, zippers, clamps, hook-and-loop fastener panels, or other suitable mechanisms. The attachment mechanism may be configured for quick attachment or release of the upper section of the rod to or from the shoulder harness. The upper end of the rod may be configured to be attached to the shoulder harness in a manner that is compatible with a standard equipment attachment system. For example, the upper end of the rod may be configured to attach to the shoulder harness using threaded straps that are compatible with the Modular Lightweight Load-carrying Equipment (MOLLE) system. As another example, the upper end of the rod may be permanently attached to the shoulder harness (e.g., riveted, bolted, screwed, clamped, stapled, or otherwise permanently, or semi-permanently, attached).

When the rod is lengthened such that the upper end of the rod supports the shoulder harness above the user's shoulders, the weight of the load may be exerted on the belt via the rod and rod holder. On the other hand, when the rod is shortened sufficiently, shoulder straps of the shoulder harness rest on the user's shoulders. In this case, the shoulder straps and the user's shoulders support the weight of the load. Intermediate lengths of the rod may enable sharing of the weight of the load between the user's shoulder and waist.

Various sections of the rod may be straight or bent. The rod includes at least two rigid elements. An end of one of the elements may be slid longitudinally relative to a cooperating end of the other element. For example, an end (male telescoping end) of one of the elements may be inserted into a hollow end (female telescoping end) of the other element. Thus, the rod elements may be telescoped within one another. Sliding one element relative to the other enables adjusting the length of the rod.

The rod includes a locking mechanism that is lockable or operable to prevent the rod elements from sliding relative to one another. A locking mechanism may include mechanical, electromagnetic, hydraulic, or other elements or components. The locking mechanism may be operated mechanically, hydraulically, electromagnetically, or otherwise. For example, the outer surface of a male telescoping end of a rod element may be provided with teeth that are extendible or retractable (e.g., via a mechanical, hydraulic, electromagnetic, or other mechanism). The inner surface of a cooperating female end of the other rod element may be provided with fixed corresponding teeth. Thus, extending the teeth on the male end may cause the extended teeth to engage the fixed cooperating teeth on the inner surface of the female end. When the teeth are engaged, no relative sliding movement is possible. Thus, the locking mechanism may fix the length of the rod when locked. Other locking mechanisms may be utilized.

A locking control may control operation of the locking mechanism The locking control is configured to be operable by a single hand of the user when the user is wearing the adjustable carrier device. Controls of the locking control are configured to be placed where the user may conveniently reach and operate the controls with a single hand while wearing the belt and shoulder harness of adjustable carrier device. For example, the controls may be configured to be clipped or strapped onto, or otherwise held in place on or near, the belt, the shoulder harness, or a part of the user's clothing or body (e.g., wrist, neck, sleeve, lapel, shirt button, or other clothing or body part).

The locking control may include one or more buttons, levers, knobs, plungers, sliders, dials, switches, or other hand-operable controls. The locking control may be configured to provide tactile (e.g., mechanical resistance), audible, or other feedback to the user to enable operation without looking at the control. The locking control may be coupled to the locking mechanism via a mechanical (e.g., Bowden cable, cable, or other mechanical), hydraulic, wired or wireless electromagnetic, optical, or other coupling or transmission mechanism.

Operation of the locking control may lock or unlock the locking mechanism For example, a locking control may include two or more states. A state may be determined by a position of a mechanical control, or by operation of another type of control. For example, the locking control may include a locked state in which the locking mechanism is locked and the length of the rod is fixed. The locking control may include a continuously unlocked state (e.g., user operates and then releases a control) in which the locking mechanism is not locked such that the length of the rod is continuously adjustable (until the control is further operated to lock the locking mechanism). The locking control may include a momentary unlocked state in which the locking mechanism is unlocked momentarily (e.g., as long as a user operates a control) to enable a single adjustment of the length of the rod, after which (e.g., when the user releases the control) the locking mechanism is locked to fix the length of the rod.

The locking control may be operated by the user in a manner that is coordinated with the user's shoulder movements. For example, momentarily releasing the locking mechanism while the user's shoulders are concurrently raised (increasing the distance between the user's shoulders and the user's waist) may increase the length of the rod. When the user's shoulders are subsequently lowered (e.g., relaxed to a natural height) some or all of the weight of the shoulder harness and the load may be redistributed to be supported by the rod, the belt, and, consequently, the user's waist. On the other hand, momentarily releasing the locking mechanism while the user's shoulders are concurrently lowered or relaxed (thus decreasing the distance between the user's shoulders and the user's waist) may cause the length of the rod to decrease (e.g., until the shoulder straps of the shoulder harness rest on the user's shoulders). In this case, some or all of the weight of the shoulder harness and the load may be redistributed to be supported by the user's shoulders.

The locking control may be operated to select a continuously unlocked state. In the continuously unlocked state, the rod elements may freely slide relative to one another so as to enable the length of the rod to freely change. When in a continuously unlocked state, the user's torso may freely bend forward or straighten from a bent forward position (e.g., enabling rotation of the user's torso that is substantially in a sagittal plane of the user's body).

In accordance with some embodiments of the present invention, a rod of an adjustable load carrier device includes telescoping elements. The rod is supported by a flexible sheath in a belt of the adjustable load carrier device.

Figure 2:
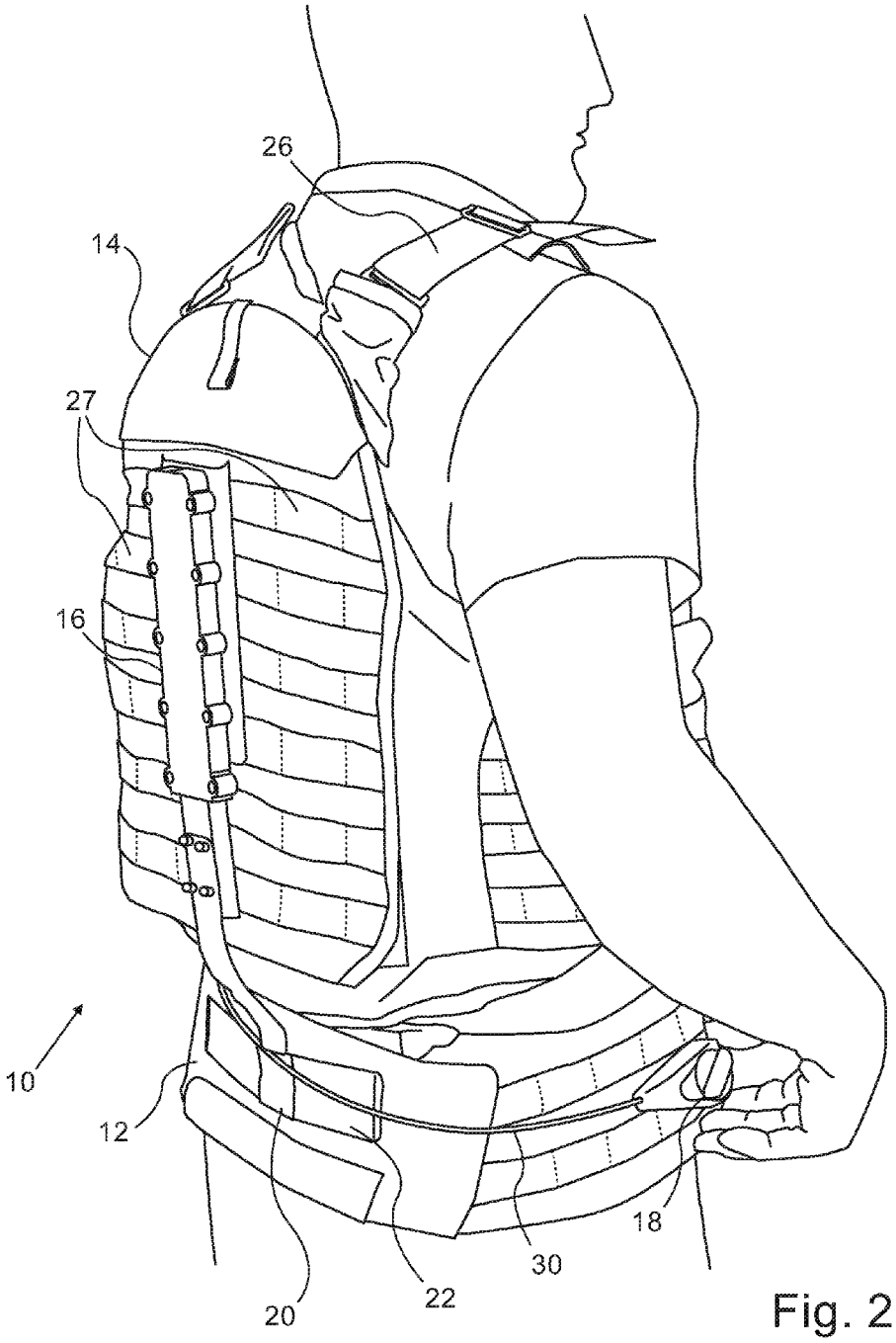
FIG. 2 shows the adjustable load carrier device of FIG. 1 as worn by a user.

FIG. 1 shows an adjustable load carrier device with telescoping rod, in accordance with an embodiment of the present invention. FIG. 2 shows the adjustable load carrier device of FIG. 1 as worn by a user.

Adjustable load carrier device 10 includes belt 12 and shoulder harness 14, connected by a telescoping rod 16. A locking mechanism that fixes the length of telescoping rod 16 may be activated or released by operation of locking control 18. Locking control 18 communicates with (e.g., transmits a motion to) the locking mechanism of telescoping rod 16 via control cable 30.

Belt 12 may be fastened around the waist of a user. For example, belt 12 may be fastened around the waist of the user using belt fasteners 24. Belt fasteners 24 may include a side release buckle, as shown in FIG. 1, or another type of fastener. For example, belt fastener 24 may include a buckle, strap, laces, loops, hooks, latches, snaps, buttons, zipper, quick release buckle, hook-and-loop fastener patches, or another fastener. Belt fasteners 24 may be configured to be fastened in front of the user, as shown, or to a side of the user.

Belt 12 includes rod sheath 20. Rod sheath 20 is positioned on belt 12 such that rod sheath 20 is located near the midline of the user's back when belt 12 is worn by the user. Rod sheath 20 is configured to hold and support a lower end of telescoping rod 16.

Alternatively or in addition to rod sheath 20, other structure of belt 12 may be configured to hold or support the lower end of telescoping rod 16 or of another rod with adjustable length. Such holding or supporting structure may include, for example, a bracket, socket, pin, latch, clamp, bolt, hole, hook, loop, screw, or other suitable structure. Structure at the lower end of telescoping rod 16 may be appropriately shaped or configured to engage the holding or supporting structure.

Rod sheath 20 is held to belt 12 by flexible strip 22. Flexible strip 22 holds rod sheath 20 and is attached to belt 12 in such a manner to enable at least limited rotation of rod sheath 20 relative to belt 12. Such rotation may enable the user's torso to lean laterally sideways or rotate laterally sideways while wearing adjustable load carrier device 10. For example, flexible strip 22 may be constructed out of webbing (e.g., out of cotton, nylon or another synthetic material, or another appropriate material), canvas, or another flexible material with sufficient strength to support telescoping rod 16 and a supported load. Ends of flexible strip 22 may be stitched, riveted, stapled, bolted, or otherwise attached to belt 12. The connection is such to enable the rotation of rod sheath 20 while preventing detachment of flexible strip 22 from belt 12.

Alternatively or in addition to flexible strip 22, other structure may be provided to enable rotation of rod sheath 20 or of another structure that is configured to hold or support telescoping rod 16 or another rod with adjustable length. Such structure may include, for example, a hinge, gimbal, pivot, joint, resilient element (e.g., a pillar made of rubber or plastic, or another resilient structure), or other structure that enables rotation of the rod with adjustable length relative to belt 12.

Belt 12 may include structure that is configured to hold one or more items in addition to rod sheath 20. For example, belt 12 may be configured to hold locking control 18 at a position that is conveniently reachable by the user's hand. The structure may include clips, fabric loops (e.g., compatible with the MOLLE system), or other appropriate structure.

Belt 12 may be constructed so as to enable the user's waist to comfortably support a load. For example, belt 12 may be constructed to be sufficiently rigid to support the load and to distribute the weight of the load about the user's waist. Belt 12 may be padded sufficiently such that the weight of the load is supported comfortably by the waist.

Shoulder harness 14 may be attached to an upper section of telescoping rod 16. Shoulder harness 14 includes shoulder straps 26 that are configured to cross the shoulders of the user. Shoulder straps 26 may be adjustable to fit a particular user. Alternatively or in addition, a shoulder harness 14 with shoulder straps 26 may be available in a variety of sizes to enable selection of a shoulder harness 14 that fits a particular user. Harness closing structure 28 may be closed in order to hold shoulder harness 14 securely to the user's body.

For example, harness closing structure 28 may include a buckle, snap, button, zipper, side-release buckle, strap, lace, surface of hook-and-loop fastener material, or another appropriate structure.

Shoulder harness 14 includes structure (e.g., pouches, loops, clips, or other appropriate structure) for supporting a load. For example, shoulder harness 14 may include MOLLE loops 27 or other structure (e.g., buckles, snaps, buttons, side-release buckles, straps, laces, eyelets, surfaces of hook-and-loop fastener material, or other structure) to which pouches or specialized equipment holders may be attached. Shoulder harness 14 may include, or may be incorporated into, a vest (such as a military vest) or other equipment carrying system.

Shoulder harness 14 may be attached to an upper section (e.g., female rod element 40, indicated in FIG. 3) of telescoping rod 16. Structure in the upper section of telescoping rod 16 may be configured to be attachable to MOLLE loops 27 or other corresponding structure of shoulder harness 14. For example, the upper section of telescoping rod 16 may include structure corresponding into which straps may be inserted. The size and spacing of the structure may correspond to that of the MOLLE system or another system. Thus, the upper section of telescoping rod 16 may be held to shoulder harness 14 by threading straps through the structure on the upper section and through for corresponding structure (e.g., loops) on shoulder harness 14.

For example, in accordance with an embodiment of the present invention, an upper section telescoping rod such as telescoping rod 16 may correspond to a female telescoping element while the lower end of the telescoping rod corresponds to the lower end of a male telescoping element. Other arrangements are possible. For example, an upper section may correspond to a male element. Alternatively or in addition, a rod of adjustable length may include elements that are configured to slide past one another. For example, both elements may be held together by rings or another surrounding structure.

Figure 3:
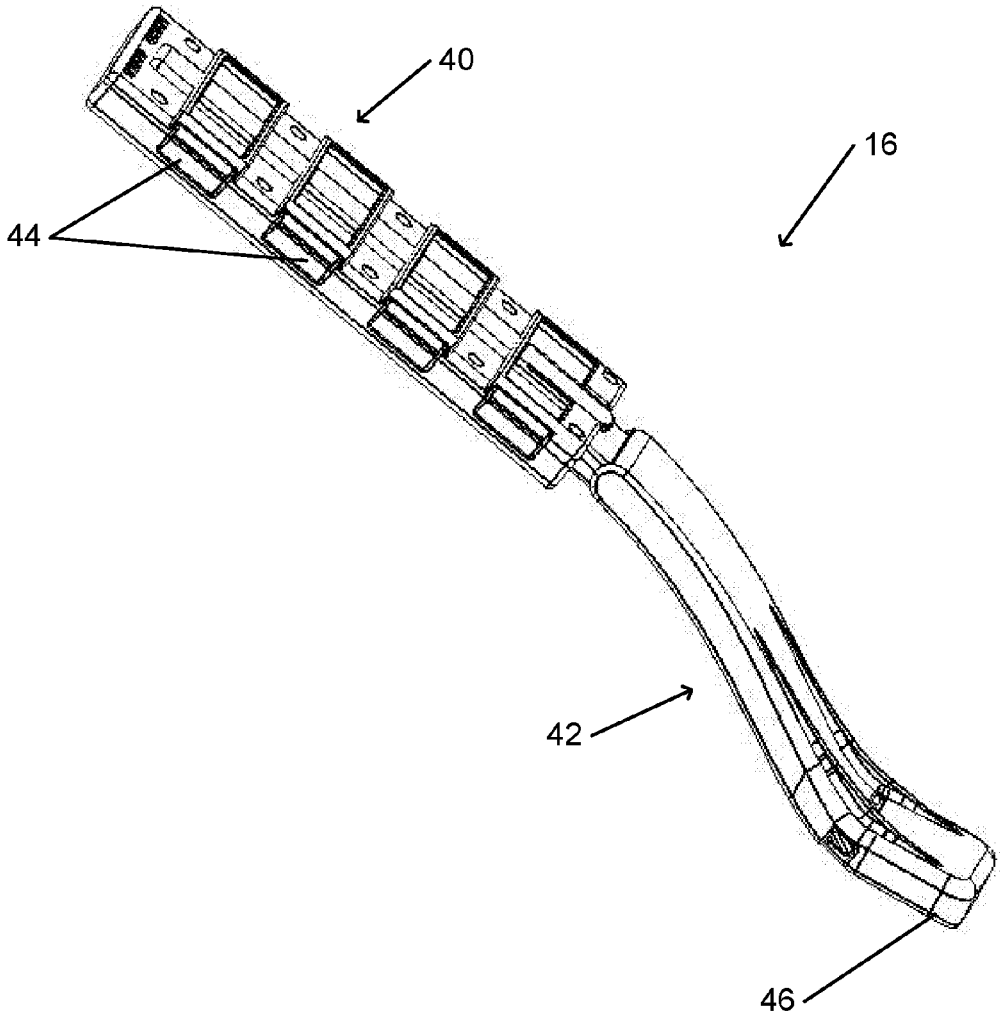
FIG. 3 shows a telescoping rod of an adjustable load carrier device, in accordance with an embodiment of the present invention.
Figure 4:
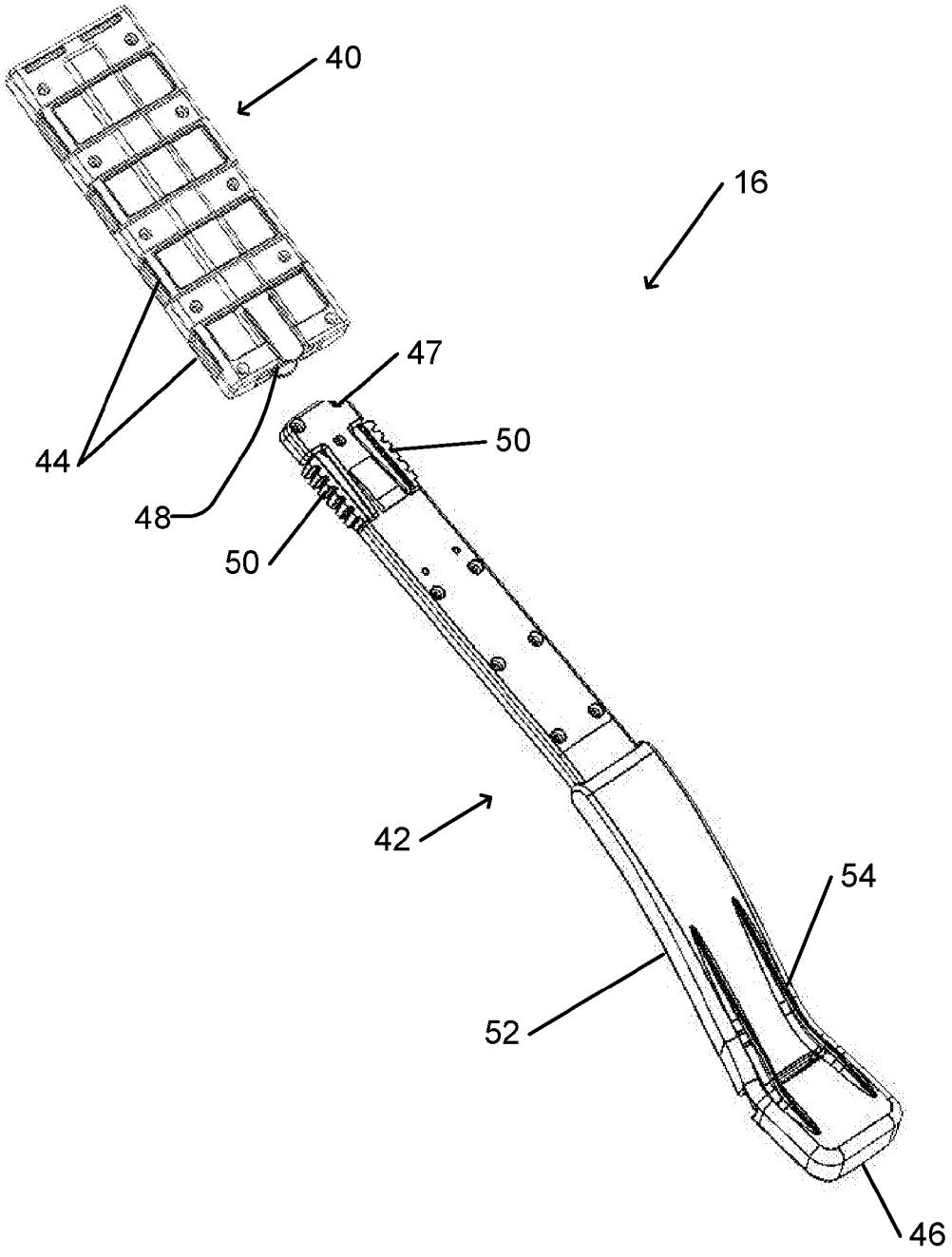
FIG. 4 shows male and female elements of the telescoping rod shown in FIG. 3.

FIG. 3 shows a telescoping rod of an adjustable load carrier device, in accordance with an embodiment of the present invention. FIG. 4 shows male and female elements of the telescoping rod shown in FIG. 3.

Telescoping rod 16 includes male rod element 42 and female rod element 40. Upper end 47 of male rod element 42 is insertable into opening 48 of female rod element 40. The length of telescoping rod 16 may be adjusting by changing the distance by which upper end 47 is inserted into opening 48.

Female rod element 40 includes strap holders 44. Female rod element 40 may be held to a shoulder harness by threading one or more straps through strap holders 44 and corresponding structure (e.g., MOLLE system loops) on the shoulder harness. Alternatively or in addition, other a female rod element may include other structure to enable attaching the female rod element to the shoulder harness.

Male rod element 42 includes extendable teeth 50 near upper end 47. When extended laterally outward, extendable teeth 50 may engage corresponding structure within female rod element 40 (e.g., fixed teeth 62 shown in FIG. 7). A mechanical locking mechanism, described below (e.g., in FIG. 6) may be operated to extend extendable teeth 50 outward to engage the corresponding structure in a locked state. Thus, telescoping of male rod element 42 within female rod element 40 is prevented, and the length of telescoping rod 16 is fixed. The mechanism may also be operated to release extendable teeth 50. When extendable teeth 50 are released, telescoping of male rod element 42 within female rod element 40 is enabled. Thus, when male rod element 42 and female rod element 40 pushed toward one another or pulled away from one another, e.g., by raising or lowering the user's shoulders, telescoping rod 16 may be shortened or lengthened.

Lower end 46 of telescoping rod 16 may be attached to belt 12 (FIG. 1). For example, lower end 46 may be inserted into rod sheath 20 of belt 12. Part of male rod element 42 may be curved to enable comfortable attachment of telescoping rod 16 to both the shoulder harness 14 and to belt 12. A bent section of telescoping rod 16 may be reinforced by reinforcing cover 52. Reinforcing cover 52 may include reinforcing structure 54. Reinforcing cover 52 and reinforcing structure 54 may prevent bending of telescoping rod 16 in a manner that may impair operation or utility of telescoping rod 16.

Telescoping rod 16 includes a mechanical locking mechanism that may be operated to prevent or enable relative sliding motion between male rod element 42 and female rod element 40. Components of the mechanical locking mechanism are incorporated into male rod element 42 and into female rod element 40.

Figure 5:
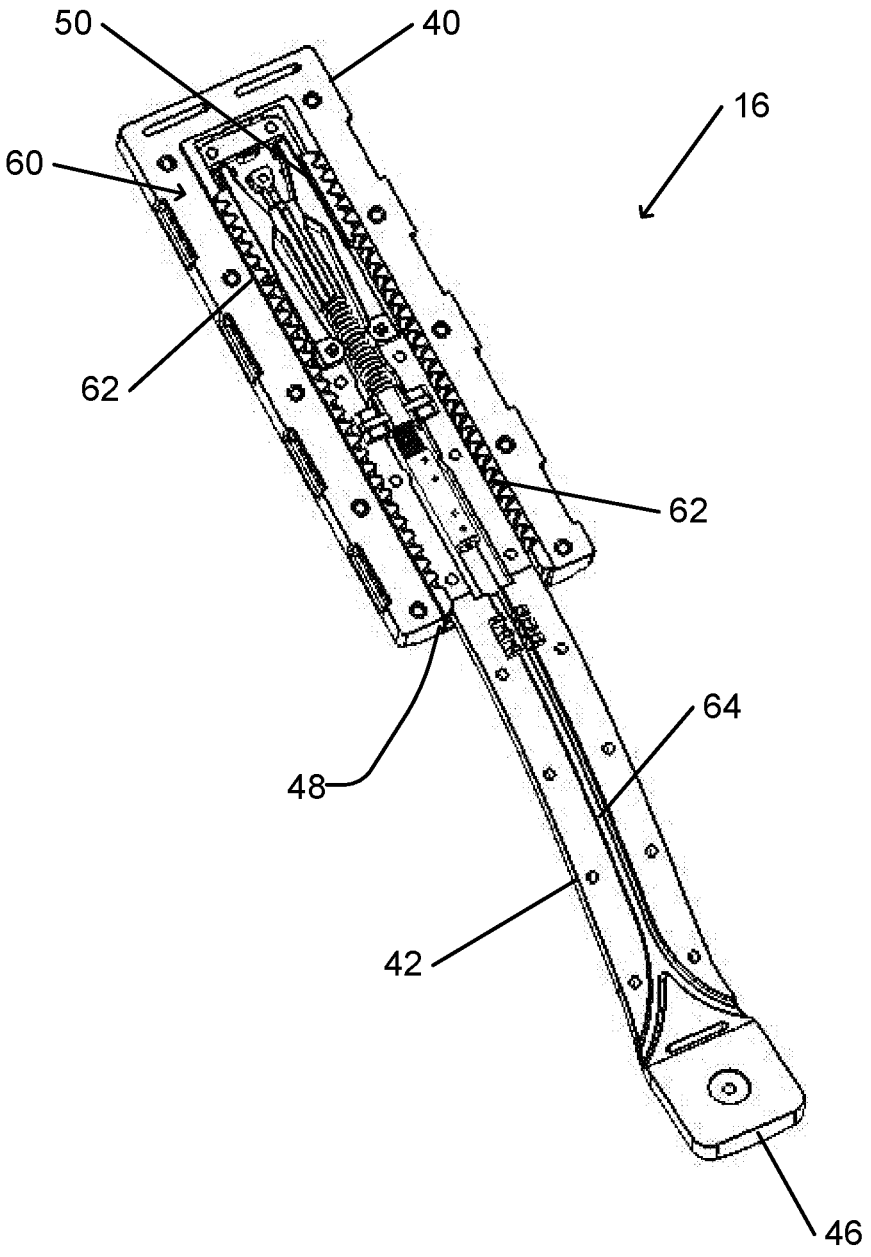
FIG. 5 shows a locking mechanism of the telescoping rod shown in FIG. 3.
Figure 6:
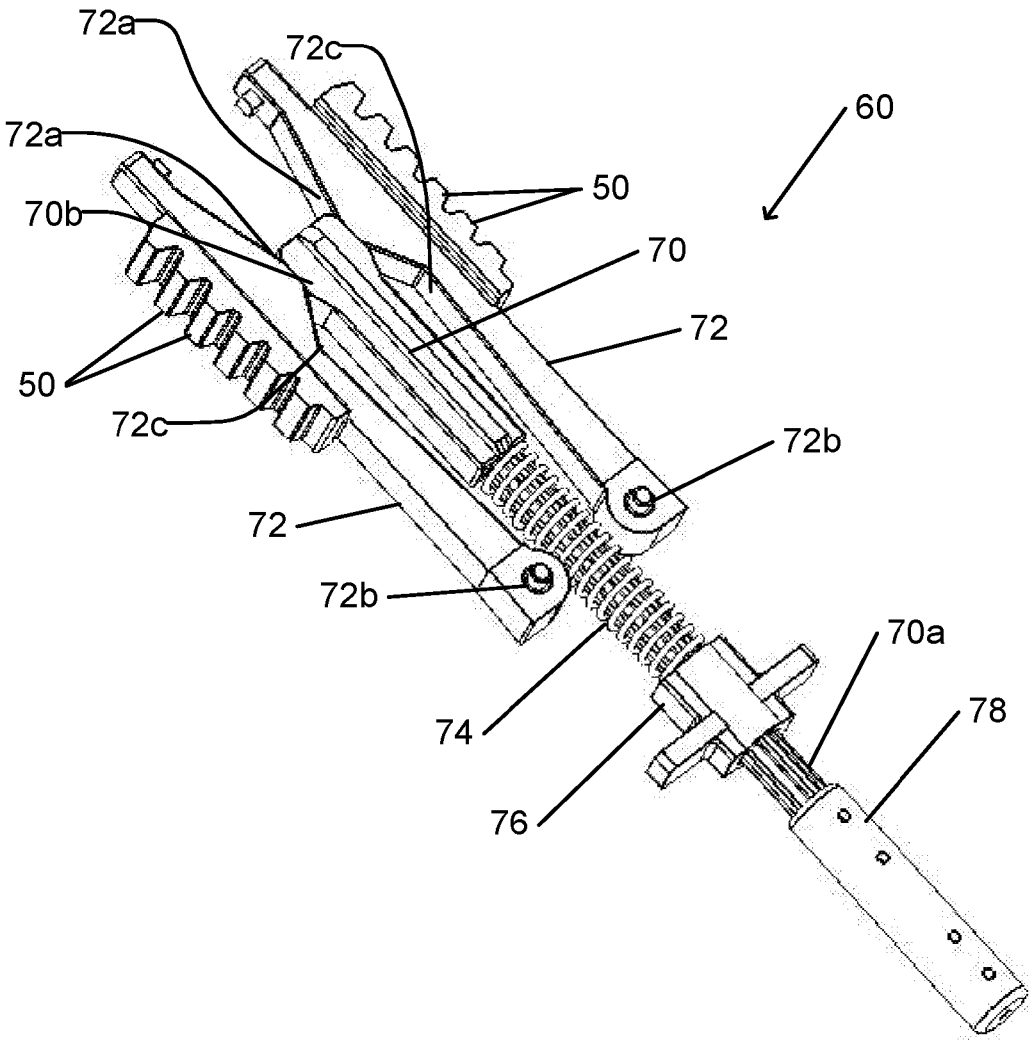
FIG. 6 shows a locking and release mechanism of the male element of the telescoping rod shown in FIG. 3.
Figure 7:
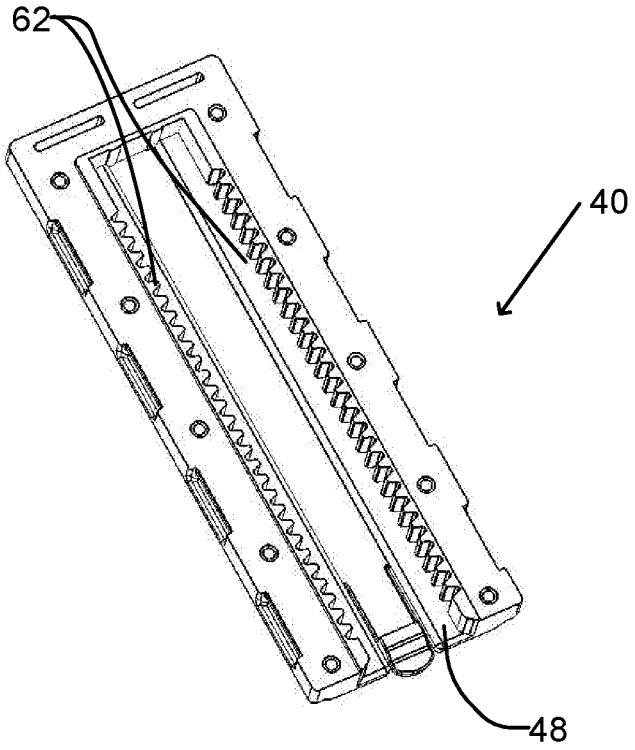
FIG. 7 shows internal structure of the female element of the telescoping rod shown in FIG. 3.

FIG. 5 shows a locking mechanism of the telescoping rod shown in FIG. 3. FIG. 6 shows a locking and release mechanism of the male element of the telescoping rod shown in FIG. 3. FIG. 7 shows internal structure of the female element of the telescoping rod shown in FIG. 3.

Mechanical locking mechanism 60 may be operated to extend extendible teeth 50 on male rod element 42 to engage fixed teeth 62 of female rod element 40 when male rod element 42 is inserted into female rod element 40. Mechanical locking mechanism 60 may be released to enable extendible teeth 50 to be retracted in response to an exerted inward force. For example, such an inward force may be exerted by fixed teeth 62 on extendible teeth 50 when male rod element 42 is further inserted into female rod element 40, or when male rod element 42 is withdrawn (partially or fully) from female rod element 40.

In the absence of a force pulling on wedge extension 70*a*, wedge spring 74 of mechanical locking mechanism 60 pushes bulge 70*b* of slidable wedge 70 between protuberances 72*a* of teeth arms 72. When so positioned, teeth arms 72 are pushed laterally outward, away from one another. Thus, extendable teeth 50 are forced outward and press against and engage fixed teeth 62 of female rod element 40. When so engaged, the relative positions of male rod element 42 and female rod element 40 are locked. Thus, the length of telescoping rod 16 is fixed.

On the other hand, wedge extension 70*a* may be pulled proximally (away from female rod element 40). When pulled, bulge 70*b* of slidable wedge 70 may be pulled to fit between indentations 72*c* of teeth arms 72. When so positioned, each teeth arm 72 is free to rotate inward (toward the other) about arm axis 72*b*. Thus, extendible teeth 50 no longer engage fixed teeth 62. Therefore, when pushed or pulled, male rod element 42 and female rod element 40 may slide (telescope) relative to one another. Thus, the length of telescoping rod 16 may be changed.

When wedge extension 70*a* is pulled, wedge spring 74 is compressed against spring stop 76. Therefore, when the pulling force is released, a restoring force of wedge spring 74 pushes on slidable wedge 70, thus relocking mechanical locking mechanism 60.

For example, extension 70*a* may be pulled via a cable, such as control cable 30 (FIG. 1). Control cable 30 may be threaded through cable conduit 64. Control cable 30 may be connected to slidable wedge 70 of mechanical locking mechanism 60 via cable connector 78. For example, if control cable 30 includes a Bowden cable, an inner cable of the Bowden cable may connect to extension 70*a* of slidable wedge 70.

In accordance with some embodiments of the present invention, a locking mechanism includes an arrangement to retract extendible teeth when the locking mechanism is released. For example, a wedge may include a structure that engages corresponding structure on each teeth arm so as to force rotate the teeth inward when the wedge extension is pulled. Such an arrangement may prevent the extendible teeth from contacting the fixed teeth when the length of the telescoping rod is changed. Prevention of contact between extendible teeth and the fixed teeth during telescoping may enable quiet operation of the mechanism (e.g., where such quiet operation is desired and audible feedback is not required).

Alternatively or in addition, other locking mechanisms may be provided. For example, a locking mechanism may include a pin on one rod element that is insertable into, and removable from, a corresponding socket, hole, or bore of the other rod element. A locking mechanism may include a friction surface or ring on one rod element that may be pressed or tightened against, or released from, a corresponding surface of the other rod element. A locking mechanism may include an electromagnet one rod element that is operable to hold or release a ferromagnetic element on the other rod element. Several mechanisms may be incorporated (e.g., an electromagnet being operable to extend or retract teeth or pins of a mechanical locking mechanism).

In accordance with some embodiments of the present invention, a locking control of the load carrier device is operated to lock or release the locking mechanism of an adjustable rod of the device. For example, the locking mechanism may be operated to apply tension to a cable. The cable, when tensioned or pulled, may release or lock the locking mechanism.

Figure 8:
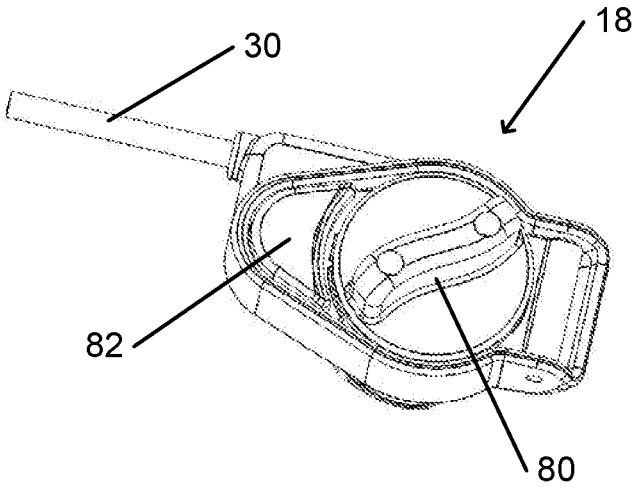
FIG. 8 shows a locking control of an adjustable load carrier device, in accordance with an embodiment of the present invention.
Figure 9:
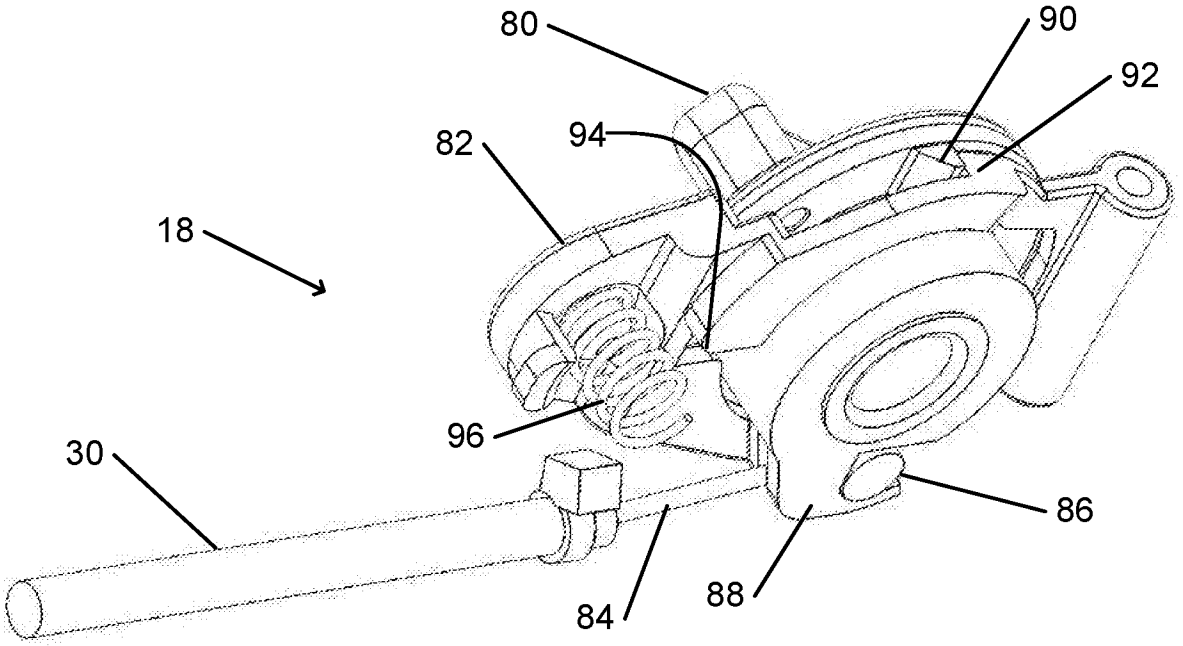
FIG. 9 shows a mechanism for operation of the locking control shown in FIG. 8.

FIG. 8 shows a locking control of an adjustable load carrier device, in accordance with an embodiment of the present invention. FIG. 9 shows a mechanism for operation of the locking control shown in FIG. 8.

Locking control 18 is configured to operate mechanical locking mechanism 60 (FIG. 5). Locking control 18 may be operated to adjust tension on cable 30. As shown, cable 30 is a Bowden cable. Inner cable 84 of cable 30 may be tensioned or pulled to operate mechanical locking mechanism 60.

Locking control 18 may be operated by operation of user operable controls. In the example, shown, the controls include knob 80 and release lever 82. Tab 90 extends from an inner-facing surface of knob 80. Cable hook 88 rotates together with knob 80

When knob 80 is released, the restoring force of wedge spring 74 of mechanical locking mechanism 60 locks telescoping rod 16. Tab 90 is pulled against locked stop 92 of release lever 82.

Knob 80 may be turned such that tab 90 is turned to a position between locked stop 92 and unlocked stop 94 of release lever 82. The turning of knob 80 causes cable hook 88 to pull cable head 86 of inner cable 84. When cable head 86 is pulled, inner cable 84 is tensioned, thus releasing mechanical locking mechanism 60. When mechanical locking mechanism 60 is opened, the length of telescoping rod 16 may be adjusted. For example, the user may increase the distance between the user's shoulders and waist, causing the length of telescoping rod 16 to be changed accordingly. (For example, a typical user may be able to change the distance between shoulders and waist over a length range of about 4 centimeters by raising or lowering the shoulders.) When the user releases knob 80, the restoring force of wedge spring 74 again locks mechanical locking mechanism 60 and returns tab 90 to locked stop 92. Thus, knob 80 may be turned partially to momentarily release mechanical locking mechanism 60 of telescoping rod 16.

Knob 80 may be turned sufficiently such that tab 90 catches unlocked stop 94 of release lever 82. Lever spring 96 holds release lever 82 in place such that unlocked stop 94 continues to hold tab 90, thus preventing reversed rotation of knob 80. (One end of lever spring 96 presses against an inward-facing surface of release lever 82. The surface of locking control 18 against which the other end of lever spring 96 is pressed is not shown for the sake of clarity of the figure.) Wedge spring 74 thus cannot restore mechanical locking mechanism 60 to a locked state. Knob 80 thus remains turned even after the user releases knob 80. When knob 80 remains turned, cable hook 88 continues to hold cable head 86 of inner cable 84 in a tensioned state. Thus, mechanical locking mechanism 60 remains in a continuously unlocked state. In this state, the length of telescoping rod 16 may be changed continuously. Thus, the user's torso may bend forward or straighten freely without, or with reduced, resistance or interference from telescoping rod 16.

The user may press release lever 82 to end the continuously unlocked state of mechanical locking mechanism 60. When release lever 82 is pressed, unlocked stop 94 is moved so as to no longer prevent reversed rotation of knob 80. The restoring force of wedge spring 74 locks mechanical locking mechanism 60 and causes inner cable 84 to pull on cable head 86. Pulling on cable head 86 returns tab 90 to locked stop 92. Thus, the length of telescoping rod 16 is again fixed.

Alternatively or in addition, other locking controls may be provided (e.g., levers, buttons, slides, cables, or other mechanisms). The locking controls may be configured to cooperate in an appropriate manner with the locking mechanism For example, a locking mechanism that includes an electromagnetically actuated component may be controlled by an appropriate electric or electronic circuit or switch. In such a case, the locking controls may be connected to the locking mechanism via an electrical cable, via an optic cable, via a wireless connection, or in another appropriate manner An adjustable load carrier device may be used as follows (referring to FIGS. 1 to 9). The order of steps, actions, or operations should be understood as being representative only. A user may change the order in accordance with the user's preference or specific need. For example, the order may be modified when the user is assisted by another person in donning and adjusting adjustable load carrier device 10.

Female rod element 40 (or another upper element of a rod with adjustable length) is attached to shoulder harness 14. For example, straps may be threaded through strap holders 44 and MOLLE loops 27 of shoulder harness 14. One or more loads (e.g., in pouches, equipment holders, or otherwise) may be attached to shoulder harness 14 (e.g., using MOLLE loops 27).

Male rod element 42 may be inserted into female rod element 40 until the length of telescoping rod 16 approximately corresponds to the height of the user. (Other components of a rod with adjustable length may be assembled.) Mechanical locking mechanism 60 locks the relative positions of male rod element 42 and female rod element 40, fixing the length of telescoping rod 16.

Lower end 46 of telescoping rod 16 is inserted into rod sheath 20 of belt 12 (or otherwise connected to the belt). The fit between lower end 46 and rod sheath 20 may be tight such that force is exerted to insert lower end 46 into rod sheath 20. The tightness of the fit may inhibit lower end 46 from coming out of rod sheath 20 without deliberate application of a force to withdraw lower end 46 from rod sheath 20.

Belt 12 may be placed about the user's waist and shoulder straps 26 may be placed over the user's shoulders. Belt 12 may be fastened around the user's waist using belt fasteners 24. Shoulder harness 14 may be fastened to the user's torso using harness closing structure 28. Locking control 18 may be attached to belt 12, to shoulder harness 14, or elsewhere to enable convenient operation of locking control 18 using a single hand. Placement of locking control 18 may be such that control cable 30 does not interfere with the user's motions.

Knob 80 of locking control 18 may be turned to momentarily unlock mechanical locking mechanism 60 while the user's shoulders are relaxed or lowered. The weight of the load held by shoulder harness 14 causes telescoping rod 16 to shorten until shoulder straps 26 rest on the user's shoulders. Knob 80 may be released so that mechanical locking mechanism 60 locks telescoping rod 16 such that the shortened length is fixed. In this state, the load is being entirely supported by the user's shoulders.

Knob 80 may be turned to momentarily unlock mechanical locking mechanism 60 while the user's shoulders are raised either fully or partially (e.g., 4 centimeters or less). The action by the user's shoulders causes telescoping rod 16 to lengthen. Knob 80 may be released so that mechanical locking mechanism 60 locks the length of telescoping rod 16 in its lengthened state. When the user's shoulders are subsequently relaxed, the weight of the load is fully or partially transferred to belt 12 via telescoping rod 16, and thus to the user's waist.

When the user wishes to bend, knob 80 may be turned to continuously unlock mechanical locking mechanism 60. In this state, the length of telescoping rod 16 changes with any change in distance between the user's shoulder and waist. Thus, the user may freely bend forward or straighten with no resistance from telescoping rod 16. When finished, release lever 82 of locking control 18 may be pushed. After release lever 82 is pushed, mechanical locking mechanism 60 is locked to fix the length of telescoping rod 16. The previously described procedures may be followed to distribute the weight of the load between the user's shoulders and waist in a desired manner

The invention claimed is:

1. An adjustable device for supporting a load, the device comprising:

a belt for fastening about a waist of a user;

a rod including two rigid elements, one of the elements being longitudinally slidable relative to the other element so as to adjust a length of the rod, the two rigid elements including a male telescoping element and a female telescoping element, the rod further including a locking mechanism that is operable to prevent sliding of the slidable element so as to fix the length of the rod, the locking mechanism including a component that is extendible outward from the male telescoping element to engage a component on the female element to lock the locking mechanism, a lower end of the rod being attachable to the belt and an upper section of the rod being attachable to a shoulder harness that is placeable on the user's shoulders for carrying the load; and a control that is operable by the user when carrying the load to unlock the locking mechanism, such that when the control is operated concurrently with movement of the user's shoulders relative to the user's waist, the length of the rod is changed to adjust a distribution of a weight of the load between the user's shoulders and waist.

2. The device of claim 1, wherein the control is operable to momentarily unlock the locking mechanism while the user is operating the control.

3. The device of claim 2, wherein the locking mechanism or the control comprises a spring to lock the locking mechanism when the user stops operating the control.

4. The device of claim 1, wherein the control is operable to continuously unlock the locking mechanism until the control is operated to lock the locking mechanism.

5. The device of claim 1, wherein the control is operable by a single hand.

6. The device of claim 1, wherein the belt comprises a sheath into which the lower end of the rod is insertable.

7. The device of claim 1, wherein an attachment of the lower end of the rod to the belt is connected to the belt by a flexible strip.

8. The device of claim 1, wherein an attachment of the lower end of the rod to the belt enables the rod to lean laterally or to rotate laterally.

9. The device of claim 1, wherein the female telescoping element is attachable to the shoulder harness.

10. The device of claim 1, wherein the upper section of the rod is attachable to the shoulder harness by straps that are threaded through loops on the shoulder harness.

11. The device of claim 1, wherein the control is operable by turning a knob.

12. The device of claim 11, wherein the control is operable to continuously unlock the locking mechanism by turning the knob until a tab of the knob engages stop.

13. The device of claim 12, wherein the control is operable to lock the mechanism after being continuously unlocked by moving the stop to release the tab from the stop.

14. The device of claim 1, wherein the control is connected to the locking mechanism via a cable.

15. The device of claim 1, wherein one of the rigid elements is curved.

* * * * *